United States Patent [19]

Prusak

[11] 4,435,922

[45] Mar. 13, 1984

[54] APPARATUS FOR GRINDING THE BACK SURFACES OF RECORD MOLDING STAMPERS

[75] Inventor: John J. Prusak, Indianapolis, Ind.

[73] Assignee: RCA Corporation, New York, N.Y.

[21] Appl. No.: 302,128

[22] Filed: Sep. 14, 1981

[51] Int. Cl.[3] ..... B24B 7/04

[52] U.S. Cl. ..... 51/58; 15/256.5; 264/39; 425/229; 425/810

[58] Field of Search ..... 51/58, 67, 33 W, 132, 51/273, 99, 359-361; 364/72, 74; 15/256.5, 236.3, 236 C; 264/39; 425/810, 229, 228

[56] References Cited

U.S. PATENT DOCUMENTS 3,545,138 12/1970 Houston ..... 51/361 X
3,826,045 7/1974 Champayne ..... 51/273 X
4,266,373 5/1981 Bornefeld et al. ..... 51/99

FOREIGN PATENT DOCUMENTS 26918 12/1931 Netherlands ..... 51/67

*Primary Examiner*—E. R. Kazenske
*Assistant Examiner*—Douglas D. Watts
*Attorney, Agent, or Firm*—Birgit E. Morris; Edward J. Sites

[57] ABSTRACT

An apparatus is disclosed for grinding the back surfaces of record molding stampers. The apparatus is comprised of a holder in which the stamper is mounted and rotated and a pressure-controlled grinder arm which is designed to engage the back surface of the stamper with an abrasive while the stamper is being rotated so as to remove surface defects.

7 Claims, 2 Drawing Figures

APPARATUS FOR GRINDING THE BACK SURFACES OF RECORD MOLDING STAMPERS

This invention relates to an apparatus for grinding the back surfaces of record molding stampers to remove surface imperfections.

BACKGROUND OF THE INVENTION

In the manufacture of molded records, such as conventional audio records or the more newly developed video discs, a plastic material, such as a polyvinylchloride molding composition, is pressed between a pair of molding plates which are referred to in the art as stampers. The stampers have defined in their molding surfaces grooves which contain a surface relief pattern which is the negative of what is desired to be molded into the record.

The stampers are obtained by a process referred to as matrixing. In the matrixing process, the information desired to be molded in the record, such as audio programming or video programming, is initially recorded on magnetic tape. The recorded tape is then used to drive a cutter head which cuts a spiral groove into a recording substrate disc. The groove has defined along its length variations in its surface relief which correspond to the desired information. The recorded substrate is replicated in a series of electroplating steps. First, the recorded substrate is electroplated with a metal, such as nickel or silver, to provide what is referred to as a master. The master is then electroplated to provide what is referred to as a mold. The mold, thereafter, is electroplated to provide an electroformed negative of the recording substrate which is the stamper.

In the matrixing steps, extreme care is taken to prevent any deformation or damage of the grooved surface of the electroformed parts in order to maintain the fidelity of the replicated surfaces to the original recording made in the recording substrate.

In the matrixing process the face surface of the replicated part, that is the grooved surfaces, are formed with a bright, extremely smooth finish. The back surface, however, is considerably different in physical appearance. After electroforming, the back surfaces of the matrix parts generally exhibit a somewhat matte-like appearance. Furthermore, there are often surface defects such as somewhat rough areas. Still further common surface imperfections are referred to as nodules. The nodules are small protuberances on the back surface of the part, which typically are about 0.02 centimeter in diameter.

Stampers which have significant amounts of surface defects on their back surface are unsatisfactory for pressing records in general, and, particularly, for pressing of video discs. In the record molding process, the stampers are mounted on smooth, steel molding platens in a molding press. The stampers form the molding surface of the molding platens. In operation, the stampers are subjected to extremely high pressures and to cyclic heating and cooling. Under these molding conditions, the defects on the back surface of the stampers can cause deformation of the entire stamper with the surface imperfections on the back being effectively transferred through to the face of the stamper. This in turn causes a distortion of the information defined in the grooves of the stamper and in the resulting records molded on the stampers.

The problems caused by defects on the back surfaces of the stampers have been recognized in the record molding industry. In an attempt to prevent problems caused by the defects on the back surfaces of the stampers, it has heretofore been suggested to visibly examine the back surfaces and to either discard those with excessive defects or to hand sand the visible defects. It has been further suggested to mount the stampers on a turntable-like device and mechanically rotate the stamper while manually holding a pad of sandpaper, emery cloth, or the like against the stamper to remove the gross surface defects from the back surface of the stampers.

Hand sanding of the stamper backs has proven to be at best only marginally acceptable. The techniques heretofore employed are dependent to a large extent on the judgment of the operators as to what is required to correct a given stamper. A further problem that is encountered is that often the operator, by using excessive pressure or sanding for an excessive length of time, introduces additional defects such as circular grind marks or the like on the back, or produces ridges as a result of uneven sanding of the stamper backs.

The problems noted above have been recognized for many years in the audio record industry, but have remained generally unresolved in that the prior art processes provided marginally satisfactory results for most types of audio records. However, with the newer video discs, the problem of defects on the back surface of the stampers presents considerably greater problems and results in a substantial rejection rate of the stampers used for the manufacture of video discs. The signal elements on a video disc are generally orders of magnitude smaller than the equivalent signal elements on an audio record; and, furthermore, the grooves on the video record are likewise orders of magnitude narrower. Accordingly, the distortion caused by defects on the back of the stampers, which would not significantly affect the audio records stamper, have been found to cause major defects in the video discs. Problems such as lock groove, skip groove, signal dropout, and the like were found to be directly related to the distortions caused in the molded records by the surface imperfections on the back side of the molding stampers.

Hand sanding of the back surface of the stampers, as heretofore employed in the audio record industry, is not satisfactory for video discs. Defects are not corrected consistently and the effects of the operator-induced defects are emphasized to a much greater degree in the molding of the video discs.

Accordingly, it would be highly advantageous if an apparatus could be provided which could be accurately controlled so as to provide a uniform amount of grinding to the back surfaces of record stampers and thereby remove the surface defects without introducing additional defects.

SUMMARY OF THE INVENTION

In accordance with this invention an apparatus is provided for grinding the back surfaces of record stampers. The apparatus includes a stamper holder assembly and a grinder arm assembly. The stamper is mounted on and rotated by the stamper holder assembly. The grinder arm assembly is positioned adjacent to the stamper holder assembly. The grinder arm assembly has an abrasive pad at one end and a pressure activating means at the opposite end for bringing the abrasive pad into grinding contact with the back of the stamper.

DESCRIPTION OF THE PREFERRED EMBODIMENTS

Figure 1:
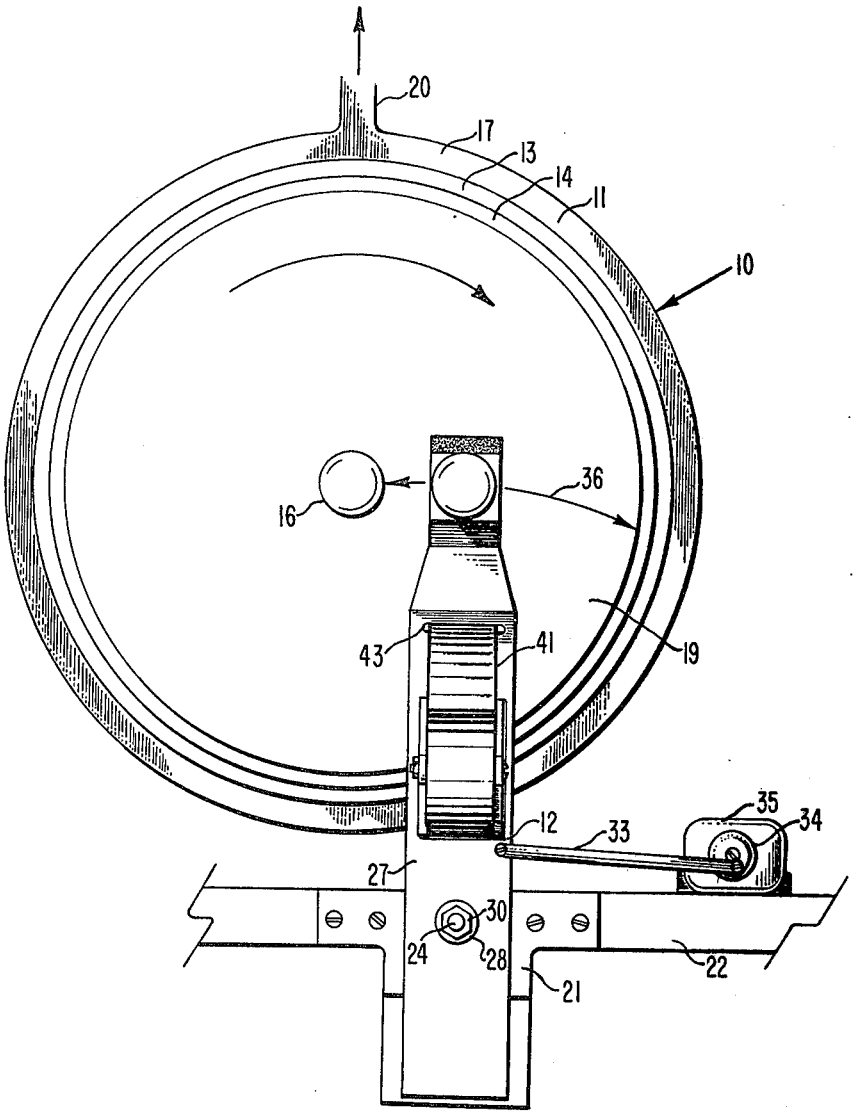
FIG. 1 is a front view of the back grinder apparatus of this invention.

The apparatus of this invention 10 is comprised of two principal assemblies, namely, the stamper holder assembly 11 and the grinder arm assembly 12.

The stamper holder assembly 11 is comprised of a support disc 13, a protective pad 14, a center hole guide 15, an attachment knob 16, a dust collector shroud 17, and a motor drive 18.

The support disc 13 is of a diameter at least as large or, more preferably, slightly larger than the stamper 19 which is to be mounted on the disc 13 for back grinding. The support disc 13 is preferably made of metal having sufficient thickness and rigidity to prevent deformation of the disc during grinding of the stamper 19 mounted thereon. The disc 13 is mounted so that it can be rotated by the motor drive 18 which has a drive shaft connected to the center of the metal disc 13. On the surface of the metal disc 13 there is secured a protective pad 14 which is preferably also of a diameter slightly larger than the stamper 19. The protective pad 14 is made of a soft, non-abrasive, heat resistant material, preferably a fabric. The purpose of the protective pad 14 is to prevent damage to the front side, that is the groove surface of the stamper 19, during grinding of the back surface.

The center hole guide 15 is a slightly raised disc mounted in the center of the support disc 13 which is of approximately the diameter of the hole in the center of the stamper 19 and is used to center the stamper on the support disc 13.

The attachment knob 16 screws into the center hole guide 15 so as to hold the stamper in place on the support disc 13.

The entire assembly of the support disc 13, the protective pad 14, the center hole guide 15, and the attachment knob 16 are positioned within a dust collector shroud 17. The dust collector shroud 17 is connected by an outlet pipe 20 to a suction means (not shown) for removal of abrasive particles and metal particles generated during grinding of the stampers 19.

Figure 2:
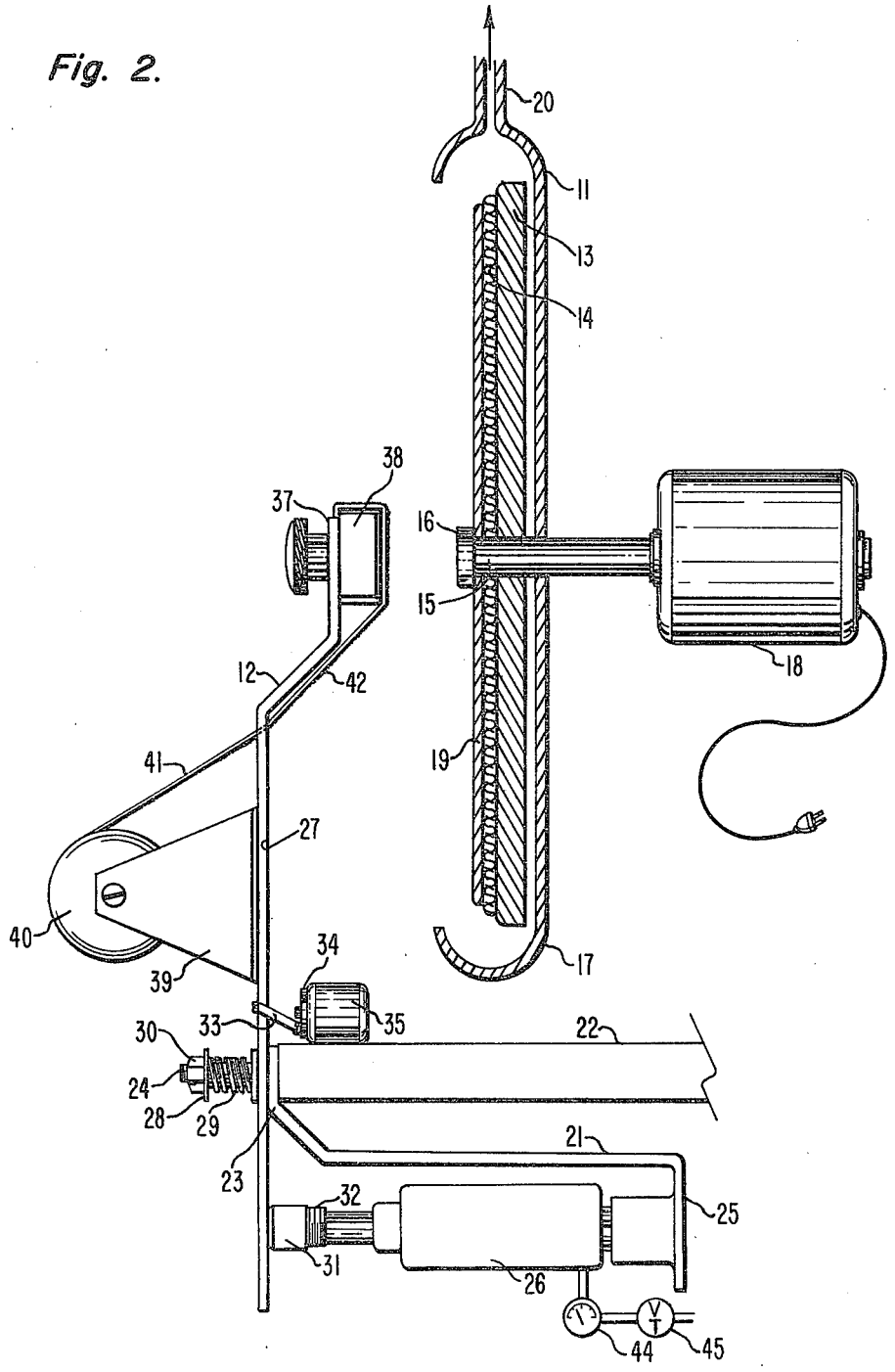
FIG. 2 is a side view taken in partial cross section of the back grinder apparatus of this invention.

The other major component of the apparatus of this invention 10 is the grinder arm assembly 12. The grinder arm assembly 12 has a fixed bracket 21 which is secured to the base 22. At a first end 23 of the fixed bracket 21, there is welded a threaded stud 24. At the opposite end 25 of the fixed bracket 21, there is secured an air activated cylinder 26. An arm 27 is pivotably mounted on the threaded stud 24 of the fixed bracket 21 at an intermediate point between the ends of the arm 27. The arm 27 is biased in a first at rest position as shown in FIG. 2 by the combination of a washer 28, a spring 29, and a hex nut 30. The desired amount of biasing force can be adjusted by tightening or loosening the hex nut 30 on the stud 24.

The lower portion of the arm 27 is in slidable engagement with the movable end 31 of the air cylinder 26. Adjustment for contact of the lower portion of the arm 27 and the movable end 31 of the cylinder 26 is made by the adjustment screw end 32.

Attached to the arm 27 is a link 33 which at its opposite end is attached to a cam 34 which is driven by a motor 35. When the motor 35 drives the cam 34, the cam moves the link 33 causing the arm 27 to oscillate as indicated by the arrow 36.

At the upper portion 37 of the arm 27 there is secured an abrasive support pad 38. The abrasive support pad 38 is preferably made of a relatively soft material which will not readily scratch the metal of the stamper 19 which is being treated. Soft wood blocks such as pine and the like are generally satisfactory for this purpose. The surface of the abrasive support pad 38 should likewise preferably be covered with a non-abrasive material similar to that used for the protective pad 14.

As illustrated, a mounting frame 39 is secured to the arm 27 which holds a roll 40 of an abrasive surface material 41. The abrasive surface material 41 with the abrasive on the bottom side 42 is fed through a slot 43 in the arm 27 and about the abrasive support pad 38. While the roll arrangement illustrated appears to be the most suitable method of providing abrasive material for the apparatus of this invention 10, it should be noted that other methods of providing the abrasive material can likewise be used, including mounting a block of abrasive material in place of the system described above.

The air cylinder 26 is of relatively conventional design and includes a pressure gage 44 and a throttle valve 45 so that the pressure applied to the movable end of the cylinder 31 at the lower end of the arm 27 can be varied and controlled as required.

In operation, a stamper 19 which is to have the back surface ground is mounted on the stamper holder assembly 11. The face surface of the stamper 19 is placed against the protective pad 14. The center hole of the stamper 19 is aligned with the center hole guide 15, and the attachment knob 16 is applied and tightened to secure the stamper to the support disc 13. The suction means of the dust collector shroud 17 is started.

The motor 18 is then started which in turn causes the support disc 13 with the stamper 19 attached to it to rotate. The speed of rotation of the support disc 13 is controlled by controlling the speed of the motor. The particular speed used in the grinding can be varied and is dependent on a series of interrelated functions as explained below.

The grinder arm assembly 12 is prepared for use by mounting a roll 40 of an abrasive surface material 41 on the arm 27. The grade of the abrasive material is likewise determined by a combination of operating parameters, as will be explained in more detail below, but is preferably of a fine grade, carbide-type paper. The free end of the roll of abrasive surface material 41 is fed through the slot 43 in the arm 27 and around the grinder block 38.

The motor 35 connected to the cam 34 and the link 33 which is attached to the arm 27 is started to cause the arm 27 to start to oscillate as noted by the arrow 36. The air cylinder 26 is then activated by introducing air into the cylinder in a controlled amount to move the arm 27 from its first at rest position, as illustrated, into engagement with the back surface of the stamper 19 which is mounted on the stamper holder assembly 11. The initial amount of pressure applied is preferably quite low so as to bring the abrasive material 41 gradually into contact with the stamper back. Once full and even contact has been made, the air pressure applied to the cylinder 26 is increased to a predetermined amount required to obtain optimum results.

To determine the optimum combination of operating conditions for employment of the apparatus of this invention for a given class of stampers, a selection has to be made from a combination of controlled variables designed into the apparatus of this invention 10.

The most important factor in the selection of suitable process parameters is the particular type of stamper which is to be treated. Stampers can be made from various types of metals or metal alloys which differ in their response to grinding because of differences in hardness, being more sensitive to heat, or the like. Even with a given type of metal, such as nickel, there can still be wide variations in hardness and texture of the metal of the stamper due to differences in the method used for electrodepositing the material to form the stamper. A still further factor in determining the correct conditions to be employed with regard to operating the apparatus of this invention is the average amount of surface defects and the type of surface defects on the stampers. Last but not least is a consideration of the desired improvement required in the condition of the back of the stamper for the intended use. As noted above, when the stamper is used for the manufacture of audio records, a lower quality standard can be employed, while the stampers for molding video discs must have a much higher degree of surface smoothness and therefore require greater care in the selection of the processing parameters employed.

Each of the variables is important. However, from practical experience the selection of the pressure applied during grinding appears to be one of the most critical parameters. The pressure is controlled by the air cylinder 26. The correct amount of pressure can be determined by a series of tests on a given class of stampers. The pressure should be sufficiently high as to effectively cause the abrasive to cut and smooth out the surface irregularities, but not so high as to cause mechanical destruction of the stamper. A pressure of about 25 pounds per square inch (353 Kg/sq. cm) generally gives satisfactory results.

The speed of rotation of the stamper holder assembly 11 which holds the stamper 19 is likewise important as it relates to the total amount of grinding to which the stamper backs will be exposed as well as the rate of grinding. It has been found, however, that except in special cases it is preferable to maintain a standard speed such as 1750 rpm so as to eliminate one of the possible variables in the process which can be changed by operators.

The speed of oscillation is not as critical as the amount of pressure or the speed of rotation. However, it is selected so as to apply a uniform amount of grinding across the stamper back. It should be noted, however, that the speed of oscillation does not have to be constant, but in certain situations is advantageously varied so as to increase the dwell time if desired at various areas of the stampers to compensate for differences in surface speed due to changes in the diameter of portions of the stamper being ground.

The selection of the abrasive used is related to the material which comprises the stamper to be ground and also the speed and pressure of grinding. In general it can be stated, however, that finer grades of abrasives, for example 250–350 grit, provide better results. It should be noted, however, with certain classes of stampers that are extremely rough at the back surface, it is often advantageous to use a series of grades of abrasives and conduct the grinding in a series of steps rather than in one grinding. The length of time of the grinding is determined by when the desired smoothness is obtained on the stamper. Once the desired smoothness is obtained, the grinding should be discontinued as all the additional grinding will do is reduce the thickness of the stamper as well as consume extra time.

Each of the variables in the control of the grinder apparatus of this invention can be specified and set for a given class of stampers to be treated. These variables include the speed of rotation of the stamper during back grinding, the grade of abrasive used, the pressure at which the abrasive is applied to the stamper, and the rate of oscillation across the stamper, and last but not least the total time of grinding. Once established the set conditions result in consistent satisfactory results being obtained with a given class of stampers. Once a satisfactory set of specifications have been determined for the given class of stampers, the operator can follow them without the use of subjective judgment and obtain satisfactory results from stamper to stamper. Furthermore, when variations in the production of the stampers are encountered which are not uncommon in the electroforming processes, minor adjustments, such as an adjustment in the amount of pressure applied, can be utilized to change the operating conditions of the grinding apparatus to compensate for the changes in the condition of the stampers.

What is claimed is:

1. An apparatus for grinding the back surface of record molding stampers, said apparatus comprising in combination: a stamper holder means and a grinding means; said stamper holding means including a disc-shaped member having a diameter at least as large as the stamper to be ground by said apparatus, a drive means for rotating said disc-shaped member about the center thereof, and means associated with said disc-shaped member for securing a stamper to be ground to a surface of the disc-shaped member; said grinding means including an elongated arm member having first and second terminal end portions, said arm member being pivotally mounted at a point intermediate between said first and second terminal end portions, said first terminal end portion having positioned thereon abrasive means for grinding said stamper, said grinding means further including pressure applying means positioned to apply pressure to said second terminal end portion and thereby pivotally move said arm member from a first position to a second position and to apply a given amount of pressure at the first terminal end portion, said grinding means further including oscillating means for continuously reciprocating said arm in a uniform manner radially back and forth across the back surface of the stamper in a plane approximately parallel to the plane of rotation of the disc-shaped member, said grinding means being spacially positioned relative to the stamper holding means so that when the arm is moved from said first position to said second position the abrasive means is brought into grinding contact at a said given amount of pressure with a stamper mounted on said stamper holding means; whereby when said stamper is mounted back surface out on the disc-shaped member of the stamper holding means, and said disc-shaped member is rotated by said drive means, and said grinding means is activated by the pressure applying means and oscillating means, the abrasive means on the arm member is moved from said first position to said second position into oscillating pressure contact with the back surface of said stamper, causing the back surface of the stamper to be ground, removing surface defects.

2. The apparatus according to claim 1 wherein the stamper holder means further includes a resilient protective pad on the surface of said disc-shaped member.

3. The apparatus according to claim 1 wherein said stamper holding means further includes a particle collection means about said disc-shaped member.

4. The apparatus according to claim 1 wherein the pressure applying means is an air cylinder.

5. The apparatus according to claim 1 wherein the pressure applying means includes means for controlling the amount of pressure applied to said arm member.

6. The apparatus according to claim 1 wherein said abrasive means includes a supply holding means mounted on said arm member means for holding a roll of an abrasive faced material.

7. The apparatus in accordance with claim 1 wherein the oscillating means includes a motor, a cam driven by said motor and a link connected between said cam and said elongated arm.

* * * * *